United States Patent [19]

Hattori et al.

[11] Patent Number: 4,869,649

[45] Date of Patent: Sep. 26, 1989

[54] WATER PUMP APPARATUS

[75] Inventors: Kenji Hattori, Toyota; Katsuhiko Eguchi, Kariya, both of Japan

[73] Assignee: Reflection Technology, Inc., Waltham, Mass.

[21] Appl. No.: 200,675

[22] Filed: May 31, 1988

[30] Foreign Application Priority Data

May 29, 1987 [JP] Japan ..... 62-085284[U]

[51] Int. Cl.[4] ..... F04B 35/00

[52] U.S. Cl. ..... 417/238; 417/364; 384/420; 384/903; 74/325

[58] Field of Search ..... 417/238, 380, 364; 415/122, 170 R, 170 A; 74/325; 384/903, 420

[56] References Cited

U.S. PATENT DOCUMENTS

| | | | |
|---|---|---|---|
| 2,862,652 | 12/1958 | Hoiby et al. | 417/364 |
| 2,902,205 | 9/1959 | Parker | 417/364 |
| 3,015,966 | 1/1962 | Howard | 74/325 |
| 3,276,742 | 10/1966 | Yokoi | 415/170 R |
| 3,782,735 | 1/1974 | Novosad | 415/170 R |
| 4,533,294 | 8/1985 | Onal | 415/122 |
| 4,573,439 | 3/1986 | Kasting | 417/364 |
| 4,688,989 | 8/1987 | Kondo et al. | 415/122 R |

OTHER PUBLICATIONS

Japanese Patent Application Laid-Open Publication No. 61-001,891 of Jan. 7, 1986.

*Primary Examiner*—Leonard E. Smith
*Assistant Examiner*—Robert N. Blackman
*Attorney, Agent, Firm*—Oblon, Spivak, McClelland, Maier & Neustadt

[57] ABSTRACT

A water pump used in a cooling system for an internal combustion engine includes a pump shaft fixedly connected to an impeller means and detachably connected to a driven gear. The driven gear is in meshing engagement with a drive gear which is detachably mounted on a cam shaft rotated by the engine. The two shafts are not axially aligned, but are arranged in parallel relationship with each other. Thus, the optimum rotational ratio between the shafts may be obtained by adjusting the radii of the gears.

5 Claims, 5 Drawing Sheets

WATER PUMP

FIELD OF THE INVENTION

The present invention relates to a water pump, and, more particularly, to a water pump which is used in a cooling system for an internal combustion engine.

BACKGROUND OF THE INVENTION

A conventional water pump used in a water-cooling system for an internal combustion engine or a water-cooled internal combustion engine is disclosed, for example, in Japanese patent application laid-open publication No. 61-001,891 published without examination on Jan. 7, 1986. In detail, as shown in FIGS. 2–4, a conventional water pump 101 includes a pump shaft 102 connected at an end portion thereof with an impeller means 103. The pump shaft 102 is in alignment with a cam shaft 100 which is rotatably mounted in a housing 104 of an internal combustion engine 105. An end portion of the cam shaft 100 is operatively connected to an output shaft 106 of the engine 105 via a timing belt T so that the output rotational movement of the engine 105 is transmitted to the cam shaft 100 while the engine is in operation. An end portion of the pump shaft 102 and an end portion of the cam shaft 100 are connected with each other in male-and-female engaging manner or by a tongue-and-groove joint 100*a*. Thus, the pump shaft 102 is rotated by the output rotational movement of the engine 105, with the result that the engine 105 is cooled by water circulated by the rotating impeller. However, due to the axial alignment between the cam shaft 100 and the pump shaft 102, the rotational ratio therebetween is determined upon installation of the water pump 101 in the engine. This means that various types of water pumps have to be prepared in accordance with the variations of the engine.

OBJECTS OF THE INVENTION

It is, therefore, a principal object of the present invention to provide a water pump without the aforementioned drawback.

Another object of the present invention is to provide a water pump that is adjustable in the rotational ratio between the cam shaft and the pump shaft.

Yet another object of the present invention is to provide a water pump in which a drive gear detachably mounted on the cam shaft is in meshing engagement with a driven gear detachably mounted on the pump shaft, which is positioned in parallel to the cam shaft.

BRIEF DESCRIPTION OF THE DRAWINGS

The above and other objects, features, and advantages of the present invention will be become apparent and more readily appreciated from the following detailed description of a preferred exemplary embodiment of the invention, taken in connection with the accompanying drawings.

DETAILED DESCRIPTION OF THE PRESENTLY PREFERRED EMBODIMENT

Figure 1:
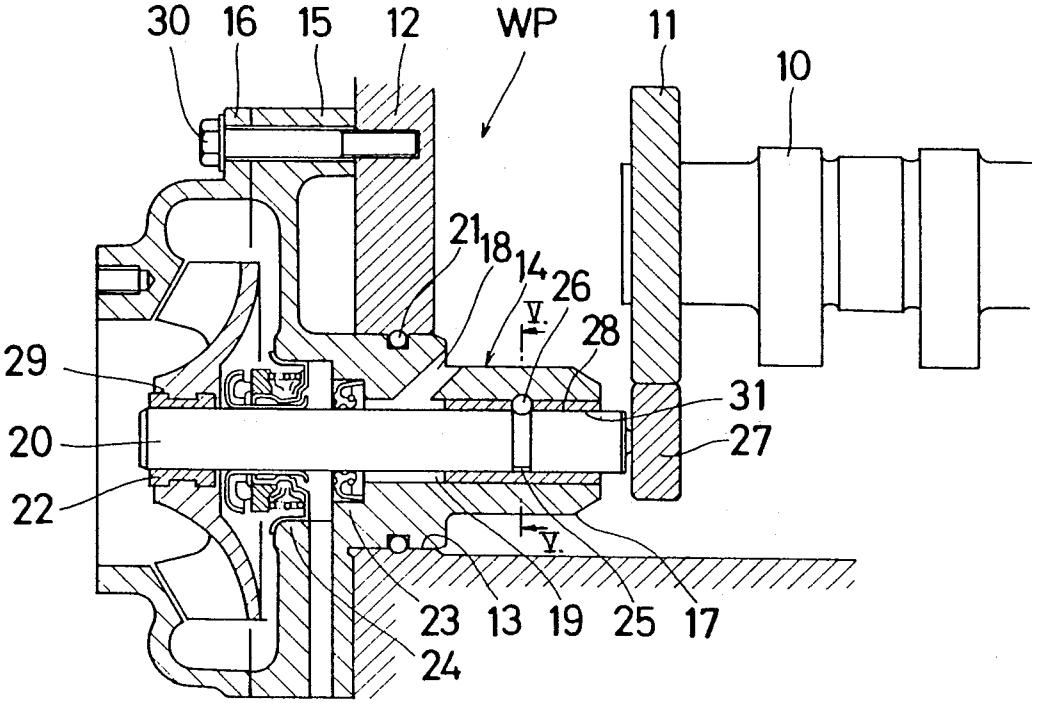
FIG. 1 is a cross sectional view of a preferred embodiment of the present invention.
Figure 2:
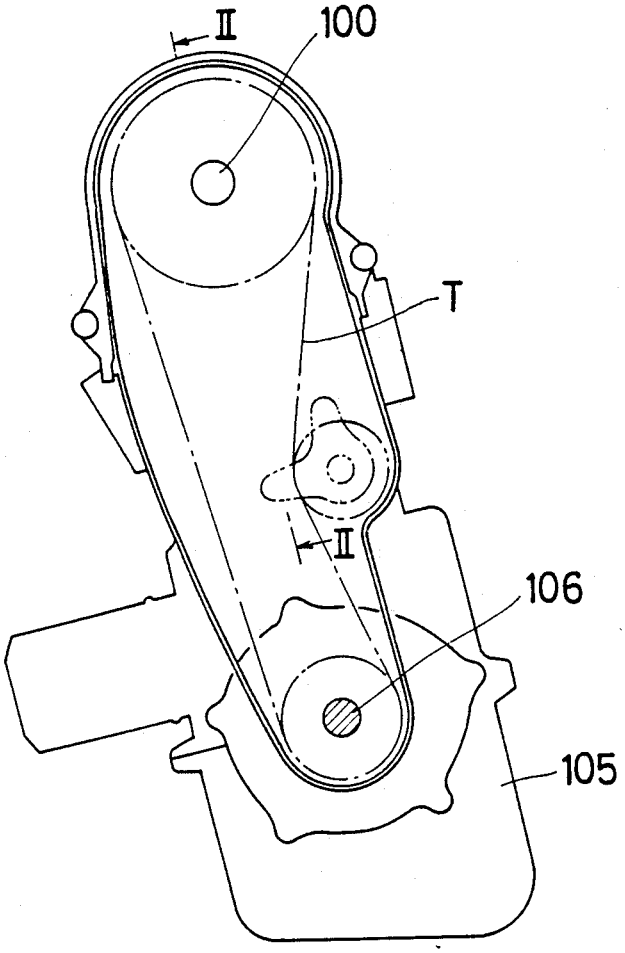
FIG. 2 (PRIOR ART)
FIG. 2 is a side elevational view of a conventional internal combustion engine.
Figure 3:
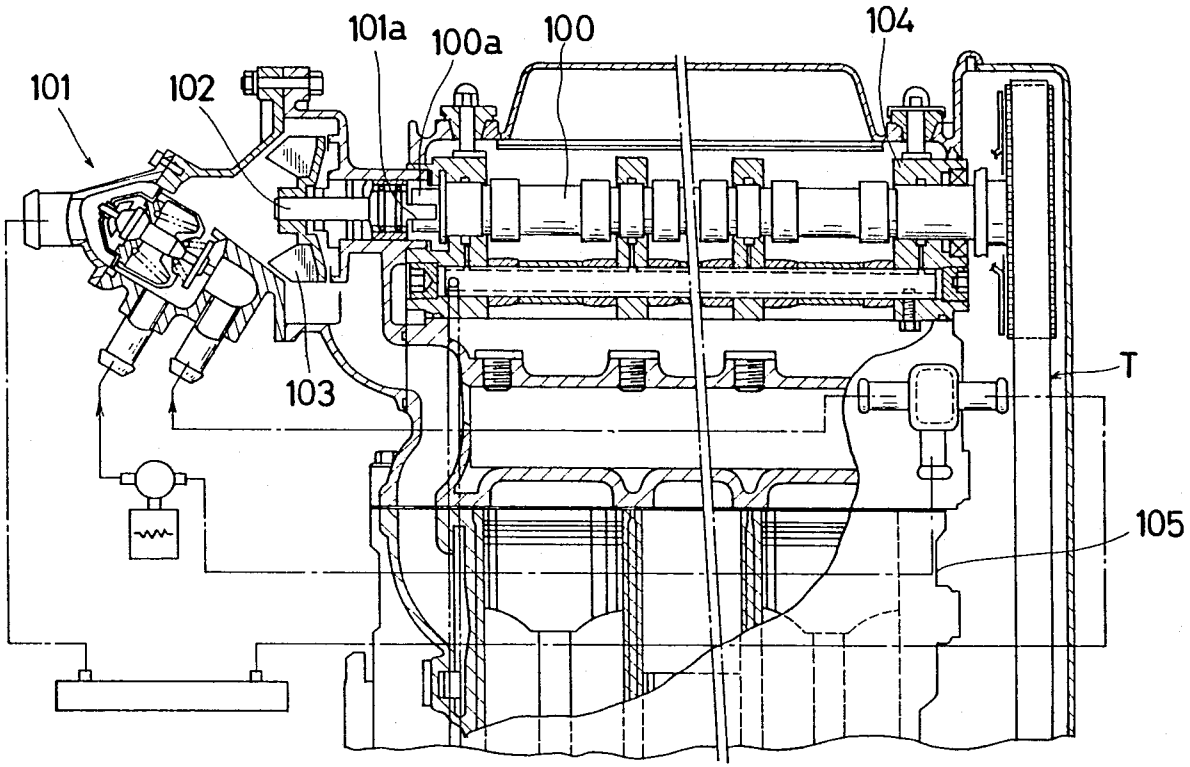
FIG. 3 (PRIOR ART)
FIG. 3 is a cross sectional view taken along the line II—II in FIG. 2.
Figure 4:
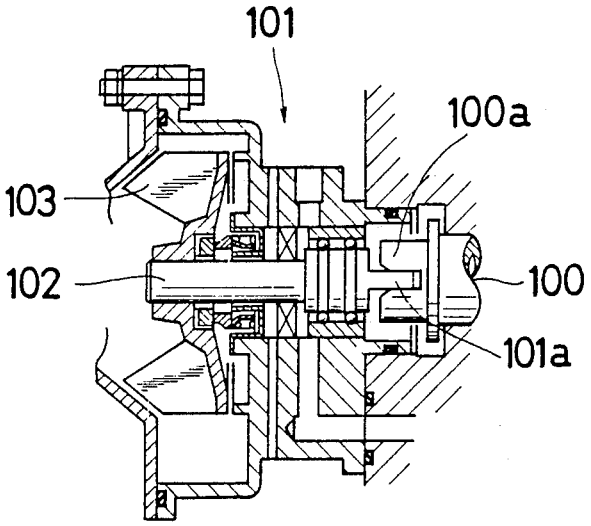
FIG. 4 (PRIOR ART)
FIG. 4 is an enlarged or detailed view of the water pump apparatus of FIG. 3.
Figure 5:
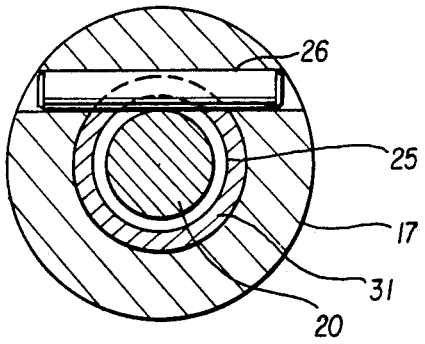
FIG. 5 is a cross-sectional view taken along the line V—V in FIG. 1.

Referring to FIG. 1, there is illustrated an overall construction of a water pump WP according to the present invention. The water pump WP comprises a cam shaft 10 which is driven by an internal combustion engine (not shown). A drive gear 11 is detachably mounted on an end portion of the cam shaft 10 and is rotatable together therewith. A side wall of a housing 12 of the engine has a hole 13 in which a main body 14 of the water pump WP is fitted. Fluid-tightness between the outer periphery of the main body 14 and the inner periphery of the hole 13 is assured by an oil seal 21 which is provided on the outer periphery of the main body 14.

The main body 14 is divided into a first housing 15 and a second housing 16. The first housing 15 and the second housing 16 are fixed to the side wall of the housing 12 by means of common bolts 30 (of which only one is shown). The first housing 15 has a small diameter portion 17. An oil path 18 is formed in the first housing 15. An oil chamber 19 is disposed inside the first housing 15.

A pump shaft 20 penetrates through the first housing 15 axially. An end portion of the pump shaft 20 projects from the right end portion of the main body 14. A driven gear 27 is detachably mounted on the pump shaft 20 and is in meshing engagement with the drive gear 11. Preferably, the radius of the drive gear 11 is larger than the radius of the driven gear 27. The left end portion of the pump shaft 20 extends into a space within the second housing 16. An impeller 29 is fixedly mounted on the pump shaft 20.

A bush 28 is arranged between the first housing 15 and the pump shaft 20. The pump shaft 20 is provided with a bush 22, an oil seal 23, and a mechanical seal 24. The pump shaft 20 has an annular groove 25. A pin 26 is driven into the main body 14 and is engaged in the groove 25 of the pump shaft 20. Thus, the pin 26 receives any axial thrust force and prevents an axial movement of the pump shaft 20. Further, pin 26 allows the rotation of the pump shaft 20.

In operation, when the engine is brought into operation, the rotational movement thereof is transmitted to the pump shaft 20 via the cam shaft 10, the drive gear 11, and the driven gear 27. Thus, the impeller 29 is rotated, thereby performing a pumping function. During the rotation of the pump shaft 20, a slipping surface 31 defined between the bush 28 and the pump shaft 20 is lubricated by oil which is introduced from an oil reservoir (not shown) through the oil path 18 and the oil chamber 19.

Since the drive gear 11 and the driven gear 27 are detachably mounted on the cam shaft 10 and the pump shaft 20, respectively, the most suitable or optimum revolutionary ratio for any given engine may be obtained by adjusting the radii of the drive gear 11 and the driven gear 27.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A water pump for use in an internal combustion engine cooling system, said water pump comprising:

(a) a cam shaft which, in use, is operatively connected to an internal combustion engine;

(b) a drive gear detachably mounted coaxially on said cam shaft;

(c) a main body having a bore therethrough in parallel relationship to said cam shaft;

(d) a first bush received in said bore;

(e) a pump shaft rotatably supported in said bush, said pump shaft having provided thereon an annular groove;

(f) a removable pin projecting from said main body through said first bush, said removable pin being received in said annular groove in said pump shaft and in said first bush:

(i) so as to allow the rotation of said pump shaft in said bush but to prevent the axial movement of said pump shaft in said bush;

(ii) so as to prevent both rotation and axial movement of said first bush; and (iii) so that removal of said removable pin permits said pump shaft and said first bush to be removed for maintenance;

(g) a driven gear detachably mounted coaxially on one end portion of said pump shaft in meshing engagement with said drive gear; and (h) impeller means fixedly mounted on the other end portion of said pump shaft.

2. A water pump for an internal combustion engine cooling system according to claim 1 wherein the radius of said drive gear is larger than the radius of said driven gear.

3. A water pump for an internal combustion cooling system according to claim 1 and further comprising:

(a) an oil seal disposed between said main body and said pump shaft on the side of said first bush remote from said driven gear;

(b) an oil chamber defined by said pump shaft, said oil seal, said first bush, and said main body; and (c) an oil path leading to said oil chamber.

4. A water pump for an internal combustion cooling system according to claim 1 wherein said main body comprises:

(a) a first housing that contains said bore and that is received in a hole in an engine wall and (b) a second housing that contains said impeller means and that is bolted to said first housing and to said engine wall.

5. A water pump for an internal combustion cooling system according to claim 1 and further comprising a second bush disposed between said pump shaft and said impeller means.

* * * * *

UNITED STATES PATENT AND TRADEMARK OFFICE

CERTIFICATE OF CORRECTION

PATENT NO. : 4,869,649

DATED : Sep. 26, 1989

INVENTOR(S) : Kenji Hattori, et al

It is certified that error appears in the above-identified patent and that said Letters Patent is hereby corrected as shown below:

Title page:

The Assignee is incorrectly recorded, "Reflection Technology, Inc., Waltman, Mass." should be:

--Aisin Seiki Kabushiki Kaisha, Aichi Pref., Japan--.

Signed and Sealed this

Twenty-sixth Day of June, 1990

*Attest:*

HARRY F. MANBECK, JR.

*Attesting Officer*

*Commissioner of Patents and Trademarks*